US005660241A

United States Patent [19]

Leising et al.

[11] Patent Number: 5,660,241

[45] Date of Patent: Aug. 26, 1997

[54] PRESSURE COMPENSATED WEIGHT ON BIT SHOCK SUB FOR A WELLBORE DRILLING TOOL

[75] Inventors: Lawrence J. Leising, Sugar Land; Howard L. McGill, Lufkin, both of Tex.

[73] Assignee: Dowell, a division of Schlumberger Technology Corporation, Sugar Land, Tex.

[21] Appl. No.: 575,942

[22] Filed: Dec. 20, 1995

[51] Int. Cl.[6] ..... E21B 17/20

[52] U.S. Cl. ..... 175/321; 267/125

[58] Field of Search ..... 175/67, 321; 267/125

[56] References Cited

U.S. PATENT DOCUMENTS

| | | |
|---|---|---|
| 3,465,817 | 9/1969 | Vincent . |
| 3,599,733 | 8/1971 | Varley . |
| 3,664,443 | 5/1972 | Campbell . |
| 3,802,502 | 4/1974 | Tanguy et al. . |
| 3,813,935 | 6/1974 | Tanguy et al. . |
| 4,099,560 | 7/1978 | Fischer et al. . |

(List continued on next page.)

OTHER PUBLICATIONS

SPE 26714 "Slim Hole and Coiled Tubing Window Cutting Systems", Sep. 7–10, 1993, Alban Faure, Herman van Elst, Rainer Jurgens, and Dietmar Krehl.

Article having the following titles and subtitles: "1. Applying Bit Weight—1.1 Bit Weight in Horizontal Wells, Reduce drill string drag, rotate drill pipe, use downhole motors, use wall anchor thrusters, use collars in upper portion of hole, use mechanicall advancing drill collars, use heavy metal collars, use decompression drill bits, use extension subs, use hydraulic thruster".

*Primary Examiner*—William P. Neuder

*Attorney, Agent, or Firm*—John E. Vick, Jr.

[57] ABSTRACT

A drilling tool, adapted to drill a wellbore in an earth formation, comprises a weight on bit equalizer shock sub. The weight on bit equalizer shock sub includes a precharged nitrogen chamber and additional chambers, the nitrogen in the nitrogen chamber adapted to telescopically open the equalizer shock sub during the drilling of the wellbore thereby maintaining a constant weight or force on the drill bit during the drilling operation. A force resultant from the pressurized nitrogen exists in the nitrogen chamber and additional forces resultant from a pressurized wellbore fluid exist in the additional chambers. The shock sub is specially designed in a particular manner to cause the sum of the force of the nitrogen in the nitrogen chamber and the additional forces of the wellbore fluid in the additional chambers to be equal solely to the force of the nitrogen in the nitrogen chamber. As a result, the weight or force on the drill bit is constant when the sum of the force in the nitrogen chamber and the additional forces in the additional chambers is equal solely to the force of the nitrogen in the nitrogen chamber. In a preferred, second embodiment, when the additional chambers include an atmospheric chamber, the weight or force on the drill bit is constant when the cross sectional area of the atmospheric chamber is equal to the cross sectional area of the nitrogen chamber. As a result, the only force on the drill bit during drilling is the force of the precharged nitrogen in the nitrogen chamber and consequently a constant weight or force on the drill bit is maintained during the drilling operation.

15 Claims, 8 Drawing Sheets

U.S. PATENT DOCUMENTS

| | | | |
|---|---|---|---|
| 4,162,619 | 7/1979 | Nixon, Jr. . | |
| 4,173,130 | 11/1979 | Sutliff et al. . | |
| 4,176,986 | 12/1979 | Taft et al. . | |
| 4,230,192 | 10/1980 | Pfannkuche . | |
| 4,254,837 | 3/1981 | Jones . | |
| 4,256,192 | 3/1981 | Aumann . | |
| 4,291,772 | 9/1981 | Beynet . | |
| 4,367,981 | 1/1983 | Shapiro . | |
| 4,394,884 | 7/1983 | Skipper . | |
| 4,398,898 | 8/1983 | Odom . | |
| 4,434,863 | 3/1984 | Garrett | 175/321 |
| 4,437,688 | 3/1984 | Kramer et al. . | |
| 4,452,413 | 6/1984 | Sipes . | |
| 4,466,496 | 8/1984 | Jones . | |
| 4,512,424 | 4/1985 | Heemstra . | |
| 4,539,851 | 9/1985 | Lutenegger . | |
| 4,597,440 | 7/1986 | Pottier . | |
| 4,712,620 | 12/1987 | Lim et al. . | |
| 5,044,614 | 9/1991 | Rau . | |
| 5,133,419 | 7/1992 | Barrington | 175/321 |
| 5,231,835 | 8/1993 | Beddome et al. . | |

WOB
PO
Pi
Pn
PI
D0
D1
D2
D3
D4
D5
DX
A2
10
40
40a
40b
40c
40d
42
42a1
44
46a
48
50
52
54
56
56a
24
0
PO(AO)
PI(AX)
PI(AX-A5)
PN(A4-A5)
PI(A4-A3)
PO(A2-A3)
PO(AO-A1)

FIG.8e
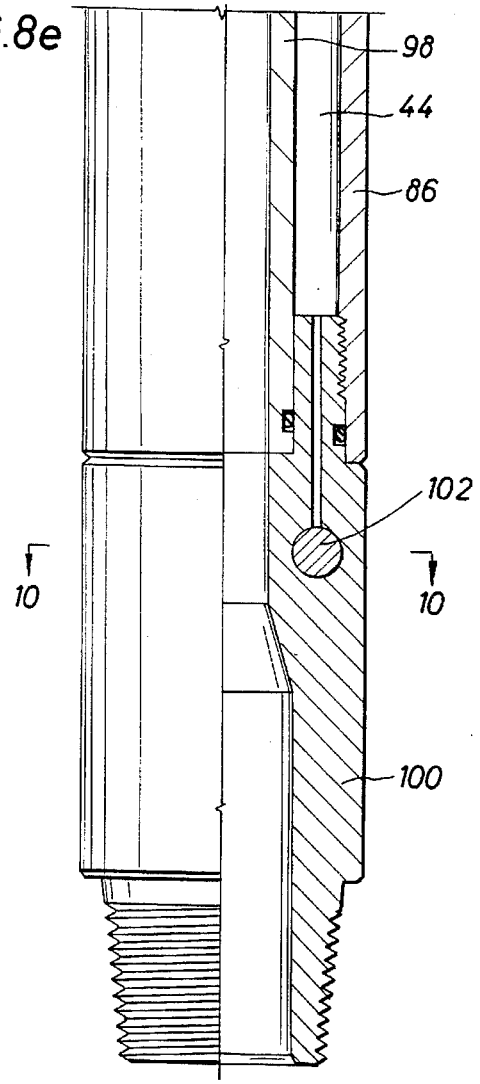
FIG.9e
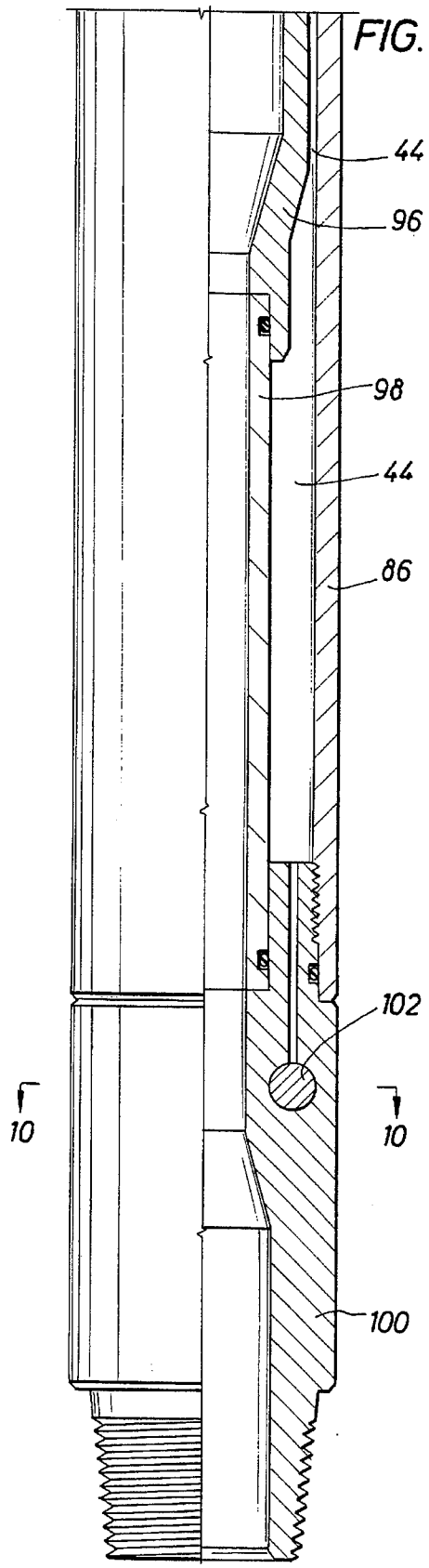
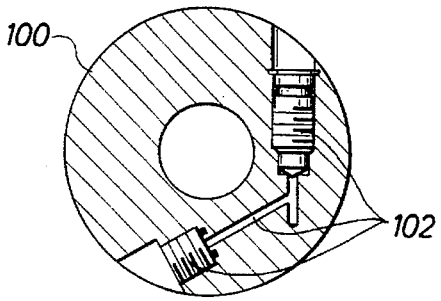
FIG.10

PRESSURE COMPENSATED WEIGHT ON BIT SHOCK SUB FOR A WELLBORE DRILLING TOOL

BACKGROUND OF THE INVENTION

The subject matter of the present invention relates to a shock sub, hereinafter known as a "weight on bit equalizer", adapted for use with a wellbore drilling tool, the drilling tool being used for drilling a hole in an earth formation known as a wellbore. More particularly, the present invention relates to a shock sub, also known as a weight on bit equalizer apparatus, adapted for use with a wellbore drilling tool, the shock sub providing a constant weight or force on a drilling bit of the wellbore drilling tool when the drilling bit is drilling a wellbore. The constant force is provided by a precharged nitrogen chamber adapted for telescopically opening the weight on bit equalizer apparatus and providing a weight or force on the drilling bit. However, an additional differential force is applied to the drilling bit; therefore, the shock sub includes a pressure compensation apparatus adapted for cancelling out the additional differential force being applied to the drilling bit thereby providing a constant weight or force on the drilling bit.

When a drilling tool is disposed in a wellbore, a drill bit on the drilling tool will contact an earth formation and a rotation of the drill bit will cause the drill bit to drill a hole, known as a wellbore, in the earth formation. When the drill bit contacts the formation during the drilling operation, it is optimum if the weight or force of the drill bit on the formation is approximately constant during the drilling operation. However, certain environmental factors exist within the wellbore, during the drilling operation, which tend to change the weight or force being applied to the drill bit. Therefore, the instantaneous weight or force of the drill bit on the formation will change from moment to moment during the drilling operation and this change will prevent the weight or force of the drill bit on the formation from being constant during the drilling operation. For example, when the drilling tool is temporarily stuck in the wellbore, a stick slip situation may tend to momentarily change the weight or force of the drill bit on the formation during the drilling operation. For example, mud with a high positive differential overbalance pressure can cause differential sticking which can cause friction that leads to the stick slip situation. Since a constant weight or force of the drill bit on the formation is desired, it is therefore necessary to build the drilling tool in a particular manner such that the adverse influence of the wellbore fluid on the drill bit is cancelled out during the drilling operation.

SUMMARY OF THE INVENTION

Accordingly, it is a primary object of the present invention to provide a shock sub or weight on bit equalizer for use with a drilling system which includes a drill bit for drilling a wellbore in an earth formation, the shock sub enabling the drilling system to provide a constant weight or force on the drill bit and the drill bit providing a constant weight or force on the formation during the drilling of the wellbore, the shock sub including an outer housing enclosing an inner housing thereby defining a nitrogen chamber and additional chambers, a force existing in the nitrogen chamber of the shock sub and additional forces existing in the additional chambers of the shock sub when the shock sub is disposed within the newly drilled wellbore, the shock sub being designed such that the sum of the force in the nitrogen chamber and the additional forces in the additional chambers is equal to the force in the nitrogen chamber since the additional forces cancel out, the weight or force on the drill bit being equal solely to the force in the nitrogen chamber.

It is a further object of the present invention to provide a weight on bit equalizer adapted for use with the drilling tool, the weight on bit equalizer providing a constant weight or force on the drill bit of a drilling tool and, as a result, the drill bit will provide a constant weight or force on the formation during the drilling operation, the weight on bit equalizer including a precharged nitrogen chamber, adapted to telescopically open the equalizer during the drilling of the wellbore thereby maintaining a particular weight or force on the drill bit during the drilling, the particular weight or force on the drill bit including a constant force and a differential force, and a pressure compensation apparatus adapted to cancel out the differential force thereby maintaining a constant weight or force on the drill bit during the drilling of the wellbore.

It is a further object of the present invention to provide a weight on bit equalizer adapted for use with the drilling tool, the weight on bit equalizer including a precharged nitrogen chamber and a pressure compensation apparatus, the nitrogen chamber adapted to telescopically open the equalizer during the drilling of the wellbore thereby maintaining a particular weight or force on the drill bit during the drilling operation, the particular weight or force on the drill bit including a constant force and a differential force which results from an adverse influence that the wellbore fluid pressures (disposed both inside and outside the drilling tool) have on the weight or force being provided to the drill bit during the drilling of the wellbore, the pressure compensation apparatus including an outside wellbore fluid pressure compensation apparatus and an inside wellbore fluid pressure compensation apparatus adapted to cancel out the differential force, the precharged nitrogen chamber in combination with the pressure compensation apparatus providing the constant force on the drill bit during the drilling of the wellbore.

It is a further object of the present invention to provide a weight on bit equalizer or shock sub adapted for use with the drilling tool, the weight on bit equalizer including an air chamber and a precharged nitrogen chamber where the cross sectional area of the air chamber is equal to the cross sectional area of the nitrogen chamber, the nitrogen chamber telescopically opening the equalizer during the drilling of the wellbore thereby maintaining a particular weight or force on the drill bit during the drilling operation, the particular weight of force including a constant force and a differential force, the differential force being cancelled out when the cross sectional area of the air chamber is equal to the cross sectional area of the nitrogen chamber, the constant force being equal to the force of the nitrogen in the nitrogen chamber, which is further equal to the pressure of the nitrogen in the nitrogen chamber multiplied by the cross sectional area of the nitrogen chamber, when the cross sectional area of the air chamber is equal to the cross sectional area of the nitrogen chamber.

These and other objects of the present invention are accomplished by providing a shock sub (also known as a weight on bit equalizer) for use with a drilling system, the drilling system including a drill bit for drilling a wellbore in an earth formation, the shock sub maintaining a constant weight or force on the drill bit during the drilling operation. The shock sub or weight on bit equalizer includes an inner housing and an outer housing enclosing the inner housing thereby defining a precharged nitrogen chamber and additional chambers, the nitrogen in the nitrogen chamber adapted to telescopically open the shock sub during the drilling of the wellbore thereby maintaining a particular weight or force on the drill bit of the drilling tool during the drilling operation. A force exists in the nitrogen chamber and additional forces exist in the additional chambers when the shock sub is disposed within the newly drilled wellbore and the drill bit of the drilling tool is drilling the wellbore. The shock sub is specially designed in a particular manner which will cause the sum of the force of the nitrogen in the nitrogen chamber and the additional forces in the additional chambers to be equal to the force in the nitrogen chamber (since the additional forces in the additional chambers cancel out). As a result, the weight or force on the drill bit is equal solely to the force of the precharged and pressurized nitrogen in the nitrogen chamber, the force in the nitrogen chamber being equal to the pressure of the nitrogen in the nitrogen chamber multiplied by the cross sectional area of the nitrogen chamber. Consequently, the constant weight or force is maintained on the drill bit during the drilling operation when the weight or force on the drill bit is equal solely to the force of the pressurized nitrogen in the nitrogen chamber In one embodiment of the shock sub of the present invention, the shock sub further includes a pressure compensation apparatus. An adverse influence in the form of a differential force originates from a wellbore fluid disposed both inside and outside the drilling tool, and the differential force is applied to the drill bit during the drilling operation. However, the pressure compensation apparatus, which includes an outside wellbore fluid pressure compensation apparatus and an inside wellbore fluid pressure compensation apparatus, cancels out the adverse influence (i.e., the differential force) which the wellbore fluid has on the weight or force being provided by the drill bit to the formation during the drilling of the wellbore. As a result, a constant weight or force is provided to the drill bit, and the drill bit provides a constant weight or force to the formation during the drilling operation. More particularly, an equation describes the weight or force being exerted by the drilling tool on the drill bit during the drilling operation. The equation includes a first term, which describes the weight or force being applied to the drill bit during the drilling operation resultant from the pressure of the nitrogen in the precharged nitrogen chamber, and a pair of additional terms, which describe the weight or force being applied to the drill bit during the drilling operation resultant from the wellbore fluid, such as mud, which is disposed both outside and inside the drilling tool. The shock sub or weight on bit equalizer apparatus of the present invention includes an outside wellbore fluid pressure compensation apparatus which is designed to cancel out one of the pair of additional terms which result from the wellbore fluid which exists outside the drilling tool, and an inside wellbore fluid pressure compensation apparatus which is designed to cancel out the other of the pair of additional terms which result from the wellbore fluid which exists inside the drilling tool. As a result, when the pair of additional terms is cancelled out, the first term of the equation is the only term that remains, and that first term describes the weight or force on the drill bit which results solely from the pressurized nitrogen in the precharged nitrogen chamber (with some alteration due to seal friction).

In another embodiment of the shock sub of the present invention, the shock sub includes the precharged nitrogen chamber as disclosed above; however, the outer and inner housings further define an air chamber, the cross sectional area of the air chamber being approximately equal to the cross sectional area of the nitrogen chamber. However, when the cross sectional area of the air chamber is approximately equal to the cross sectional area of the nitrogen chamber, the only force which is produced on the drill bit during the drilling operation is a constant force resultant from the pressure of the nitrogen in the nitrogen chamber, that is, such constant force ("WOB") being equal to "Pn(A)", where "Pn" is the pressure of the nitrogen in the nitrogen chamber and "A" is the cross sectional area of the nitrogen chamber.

Therefore, by using the weight on bit equalizer apparatus in accordance with the present invention, the only weight or force being applied to the drill bit of the drilling tool, and the only weight or force being applied by the drill bit to the formation, is the weight or force originating from the pressurized nitrogen in the precharged nitrogen chamber.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 3–5 illustrate one embodiment of the shock sub or weight on bit equalizer of the present invention, FIG. 3 illustrating the precharged nitrogen chamber, FIG. 4 illustrating the outside wellbore fluid pressure compensation apparatus, and FIG. 5 illustrating the inside wellbore fluid pressure compensation apparatus;

FIGS. 6–10 illustrate another, second embodiment of the shock sub or weight on bit equalizer of the present invention, where:

FIGS. 6 and 7 illustrate a simplified construction of the second embodiment of the weight on bit equalizer, FIGS. 8*a*–8*e* illustrate a detailed construction of the second embodiment of the weight on bit equalizer apparatus of FIGS. 6–7 shown in a collapsed configuration;

FIGS. 9*a*–9*e* illustrate a detailed construction of the second embodiment of the weight on bit equalizer apparatus of FIGS. 6–7 shown in an extended configuration; and FIG. 10 illustrates a cross section of FIGS. 8*e* and 9*e* taken along section lines 10—10 of FIGS. 8*e* and 9*e*.

DETAILED DESCRIPTION OF THE PREFERRED EMBODIMENTS

Figure 1:
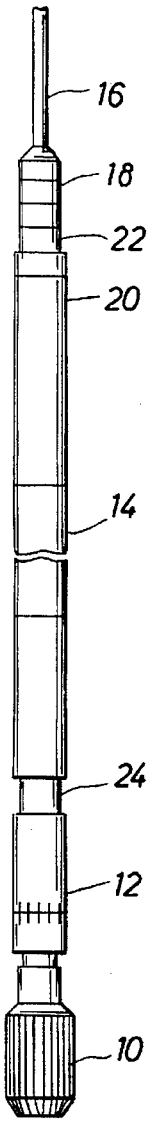
FIG. 1 illustrates a drilling tool which could utilize the weight on bit equalizer of the present invention.

Referring to FIG. 1, a typical drilling system is illustrated. The drilling system includes a drill bit 10 operated by a mud motor 12. The tool string of the drilling tool includes drill collars 14, a coiled tubing 16, a coiled tubing connector 18 adapted to connect 16 to the drilling tool, a disconnecting sub 20 adapted for disconnecting the coiled tubing 16 from the drilling tool, and a check valve assembly 22 adapted for allowing a fluid to conduct in one direction only inside the coiled tubing 16, the one direction being from the coiled tubing 16 to the mud motor 12 for operating the mud motor and rotating the drill bit 10. A weight on bit equalizer apparatus 24 in accordance with the present invention could be disposed directly above the mud motor 12 in the tool string of the drilling system of FIG. 1.

Figure 2:
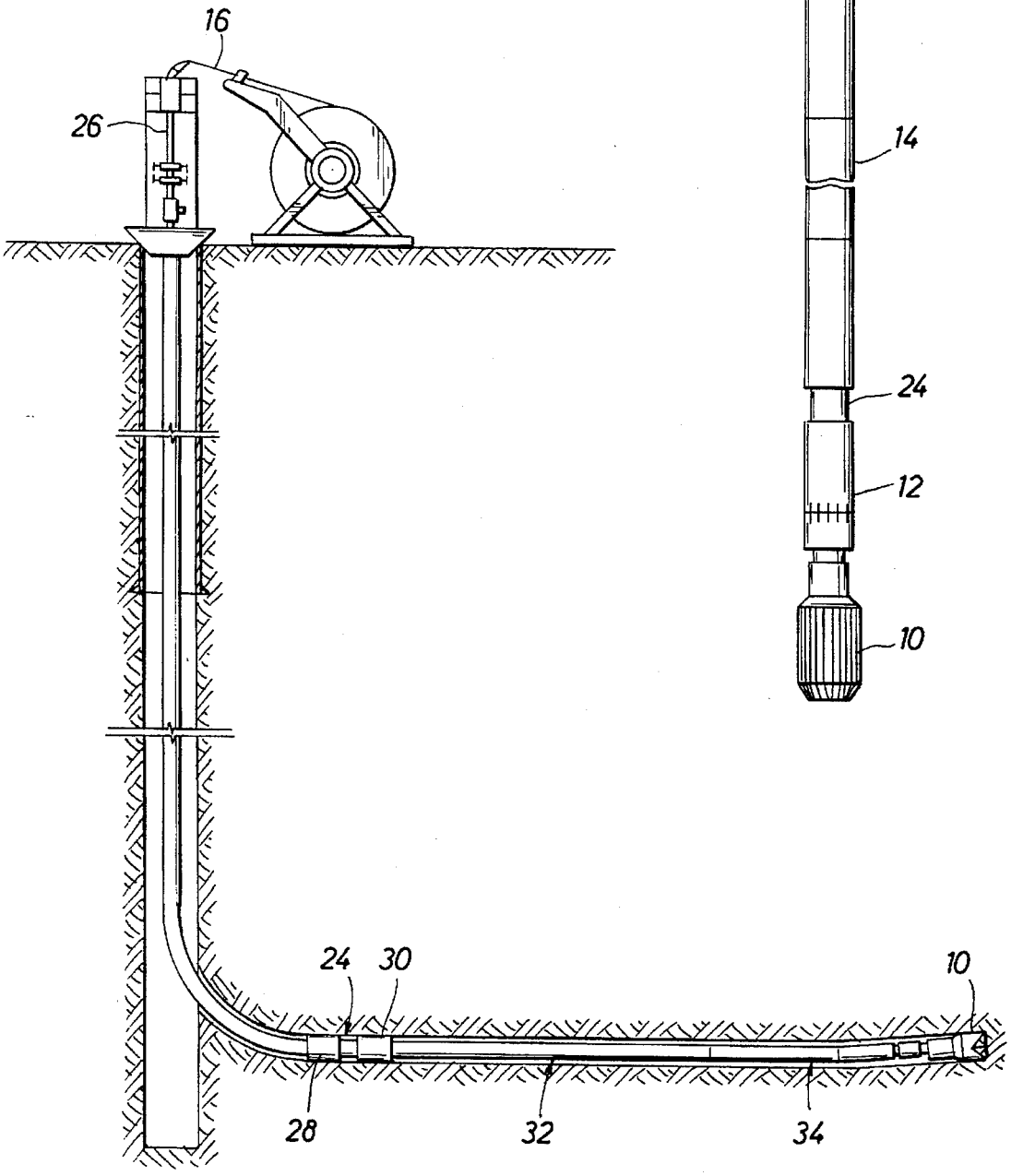
FIG. 2 illustrates another drilling tool which could utilize the weight on bit equalizer of the present invention.

Referring to FIG. 2, another typical drilling system is illustrated. This drilling system is adapted to be disposed in a deviated wellbore. In FIG. 2, the drilling system would include an apparatus 26 for receiving the coiled tubing 16, a further apparatus including a coiled tubing pull or pressure release 28, the weight on bit equalizer apparatus 24 of the present invention, an orienting tool 30 adapted for orienting the tool string in a desired azimuthal direction in the deviated wellbore, a steering tool 32, and a downhole motor with bent housing 34 for rotating the drill bit 10 in the wellbore. The drill bit 10 rotates and drills a hole in an earth formation known as a wellbore or borehole.

In both FIGS. 1 and 2, the weight on bit equalizer 24, in accordance with the present invention, applies a constant weight or force to the drill bit 10, and the drill bit 10, in turn, applies a constant weight or force to the earth formation during the drilling operation. The weight on bit equalizer 24 operates (only in principle) like a shock absorber, absorbing a shock each time the drill bit 10 contacts the formation during the drilling operation and simultaneously applying a constant weight or force to the drill bit 10 while the drill bit 10 drills the wellbore in the formation; however, since seal friction prevents the very small motions envisioned with a shock absorber, the weight on bit equalizer 24 will only extend if the weight on the bit 10 falls below a preset mount.

The shock sub or weight on bit equalizer 24 maintains a constant weight or force on the drill bit 10 during the drilling operation. It does this because of its unique design. For example, the shock sub or weight on bit equalizer 24 includes an inner housing and an outer housing enclosing the inner housing thereby defining a precharged nitrogen chamber and additional chambers, the nitrogen in the nitrogen chamber adapted to telescopically open the shock sub during the drilling of the wellbore thereby maintaining a particular weight or force on the drill bit of the drilling tool during the drilling operation. A force exists in the nitrogen chamber and additional forces exist in the additional chambers when the shock sub is disposed within the newly drilled wellbore and the drill bit of the drilling tool is drilling the wellbore. The shock sub is specially designed in a particular manner which will cause the sum of (1) the force of the nitrogen in the nitrogen chamber, and (2) the additional forces in the additional chambers, to be equal solely to the force in the nitrogen chamber (since the additional forces in the additional chambers cancel out). As a result, except for a force due to friction, the weight or force on the drill bit is equal solely to the force of the precharged and pressurized nitrogen in the nitrogen chamber, the force of the nitrogen in the nitrogen chamber being equal to the pressure of the nitrogen in the nitrogen chamber multiplied by the cross sectional area of the nitrogen chamber. Consequently, the constant weight or force is maintained on the drill bit during the drilling operation when the weight or force on the drill bit is equal solely to the force of the pressurized nitrogen in the nitrogen chamber Referring to FIGS. 3 through 5, the shock sub or weight on bit equalizer in accordance with a first embodiment of the present invention is illustrated. In the first embodiment, the weight on bit equalizer essentially comprises four parts: (1) a precharged nitrogen chamber shown in FIGS. 3, 4, and 5, (2) an outside wellbore fluid pressure compensation apparatus shown in FIG. 4, (3) an atmospheric chamber shown in FIG. 4, and (4) an inside wellbore fluid pressure compensation apparatus shown in FIG. 5.

Figure 3:
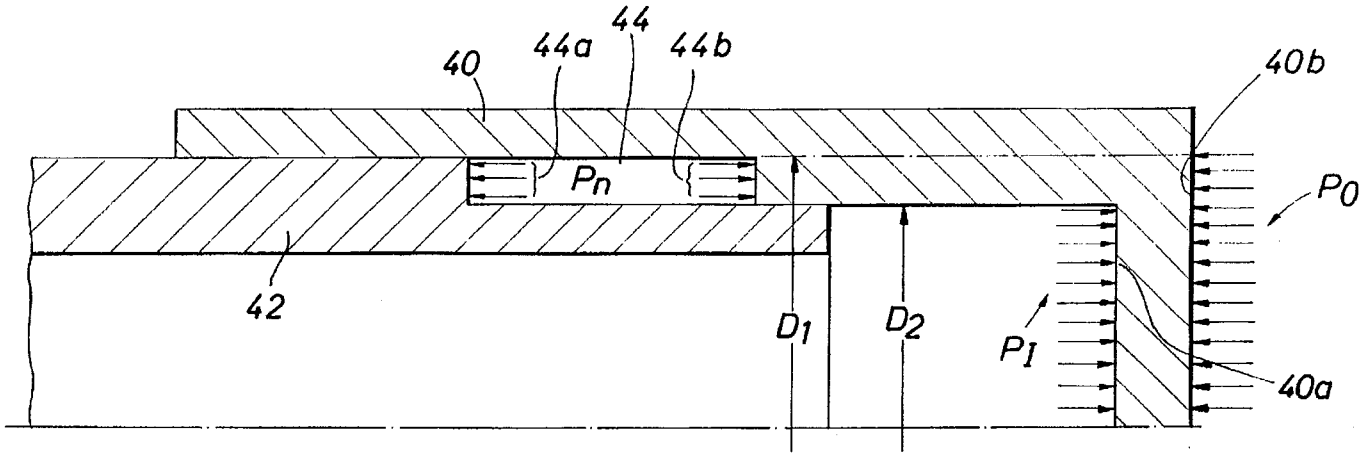

In FIG. 3, the weight on bit equalizer of the present invention includes an outer housing 40 which can move longitudinally with respect to an inner housing 42. The outer and inner housings 40 and 42 define a chamber 44. The chamber 44 is filled with Nitrogen, the Nitrogen in the chamber 44 being precharged to a predetermined pressure. Since the chamber 44 is precharged with Nitrogen, the precharged Nitrogen in chamber 44 tends to push the outer housing 40 in one direction and to push the inner housing 42 in a direction opposite to the one direction; that is, the inner and outer housings 40 and 42 tend to move away from each other in response to the pressure of the precharged nitrogen. As a result, the weight on bit equalizer of the present invention will tend to telescopically open in response to the nitrogen pressure in the chamber 44. For example, in chamber 44, see arrows **44*a* and 44*b*** which are oppositely directed.

This function of the weight on bit equalizer of the present invention is important for the following reasons. When the drilling tool of FIG. 1, for example, becomes temporarily stuck in the wellbore (known as a "stick slip" situation), the BHA stops advancing and, as the bit 10 drills the adjacent material, the pressure on the drill bit 10 begins to decrease. Since the pressure on the drill bit 10 decreases, the outer housing 40 can now move with respect to the inner housing 42. As a result, when the outer and inner housings move with respect to one another, the contact pressure on the drill bit 10 (the contact pressure between drill bit and earth formation) begins to return to its former value. Therefore, the weight or force of the drill bit 10 on the formation is self correcting and tends to remain constant. However, the pressure of the wellbore fluid, disposed both inside and outside the drilling tool, tends to prevent the weight or force of the drill bit 10 against the formation from remaining constant. Therefore, the presence of the wellbore fluid, both inside and outside the weight on bit equalizer, must be taken into account in order for the weight or force of the drill bit 10 against the formation to remain constant.

In order to take into account the pressure of the wellbore fluid disposed inside and outside the weight on bit equalizer of the present invention, consider the following analysis with reference to FIG. 3, FIG. 3 being a free body diagram.

In FIG. 3, assume that a pressure "Pn" denotes the pressure of the nitrogen in the nitrogen chamber 44. The Pn pressure is directed against the opposite wails of the chamber 44, as illustrated in FIG. 3. Assume further that the wellbore fluid disposed inside the weight on bit equalizer exerts a pressure "Pi" against an inside surface **40*a* of the outer housing 40 as shown in FIG. 3. Assume further that the wellbore fluid disposed outside the weight on bit equalizer exerts a pressure "Po" against an outside surface 40*b* of the outer housing 40. Assume that the inside surface 40*a* has an area "A2" and the outside surface 40*b* has an area "A1" as illustrated in FIG. 3. With the variables Pn, Pi, Po, A2, and A1 defined, the weight on the drill bit 10 (denoted by the acronym "WOB") of FIGS. 1 or 2** can be defined by the following equation (bit nozzle area A3is assumed to be zero for this discussion):

$$WOB=Pn(A1-A2)+PiA2-PoA1 \quad (1)$$

The WOB has units of pounds, the variable Pn has units of pounds/square inch, and the areas A1, A2 have units of square inch. The terms Pn(A1−A2) and PiA2 have a plus sign because the pressure on drill bit 10 from the pressurized nitrogen in the nitrogen chamber 44 and the pressure on the inside surface 40*a* of outer housing 40 from the wellbore fluid disposed inside the weight on bit equalizer are directed in the same first direction. However, the term PoA1 has a negative sign because the pressure on the outside surface 40*b* from the wellbore fluid disposed outside the weight on bit equalizer is directed in a second direction which is opposite to the first direction. Note the term (+PiA2–PoA1), which will hereinafter be called "the specific term".

Clearly, in order to take into account the presence of the wellbore fluid disposed both inside and outside the weight on bit equalizer of the present invention, the specific term "PiA2–PoA1", in the WOB equation (1) set forth above, must be eliminated. To eliminate the specific term in the WOB equation (1), the weight on bit equalizer apparatus of the present invention must be designed in such a way that the specific term "PiA2–PoA1" in the WOB equation (1) is eliminated.

Figure 4:
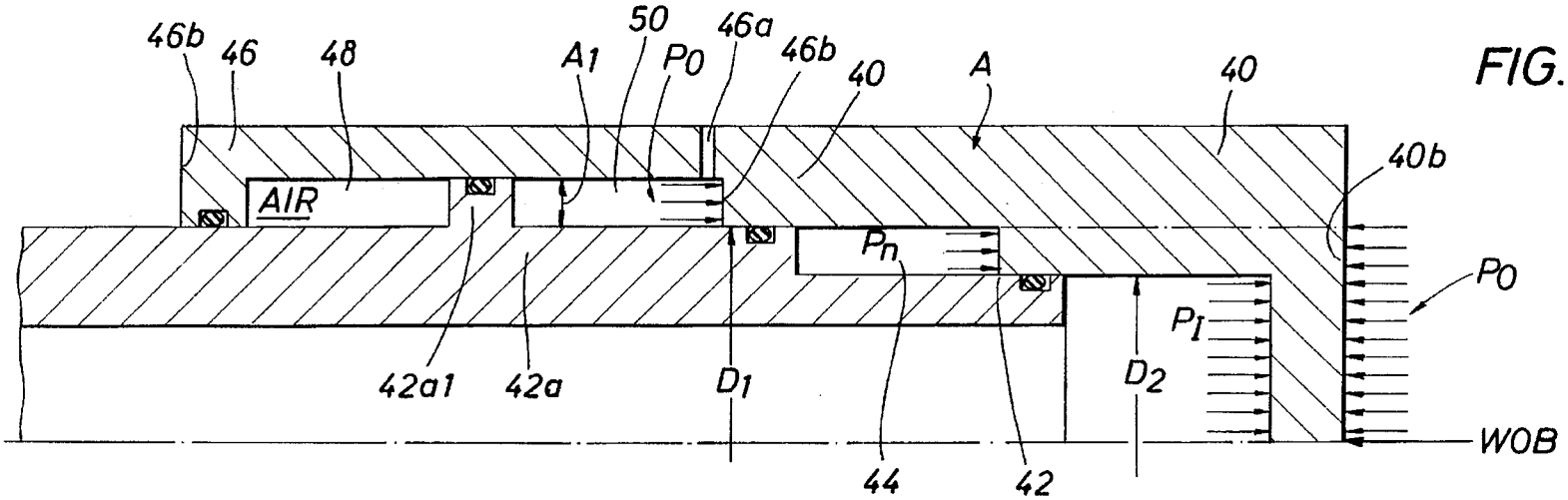
Figures 5, 6, 7:
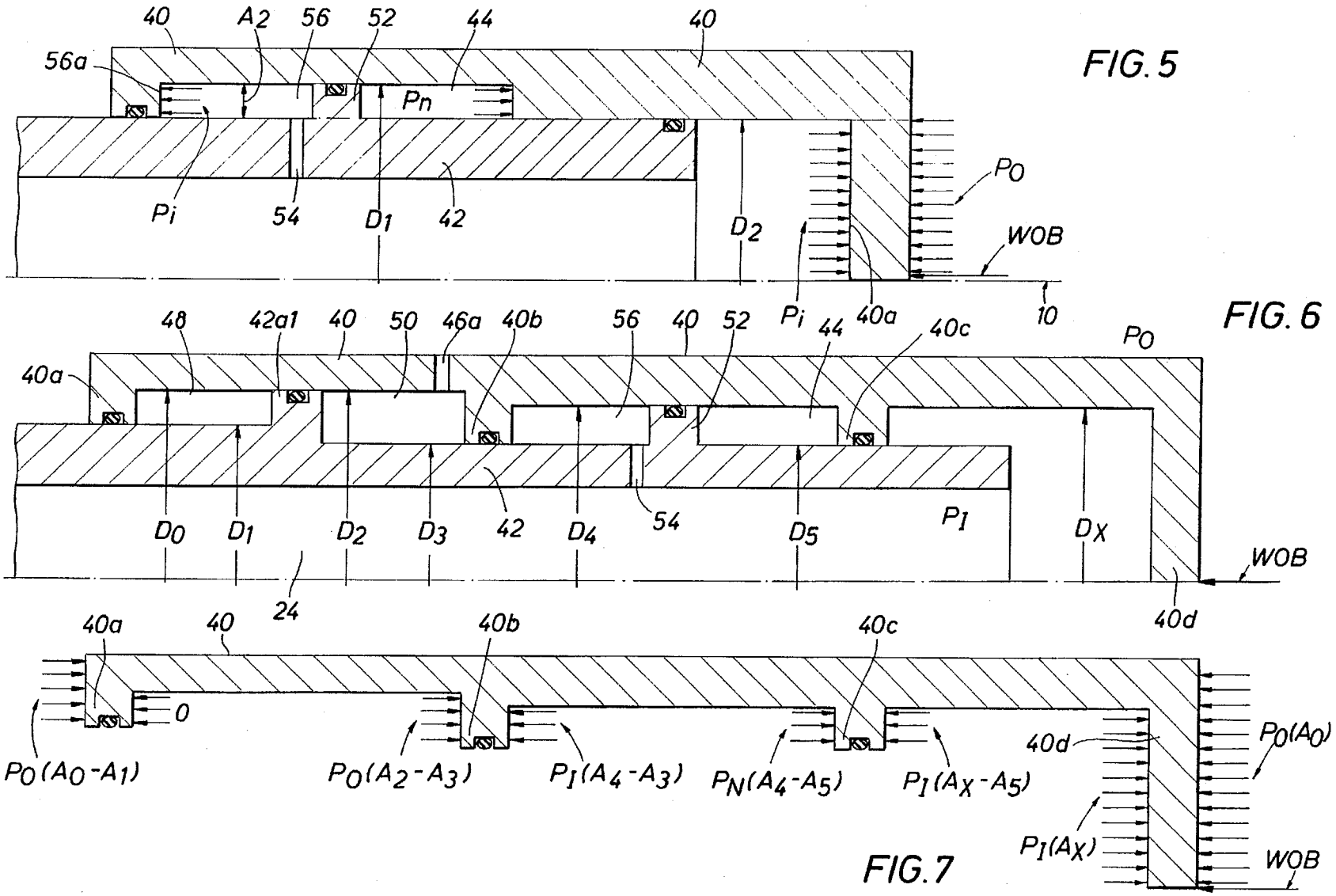

FIGS. 4 and 5 will illustrate additional weight on bit equalizer 24 structure in accordance with the first embodiment of the present invention that must be added to the weight on bit equalizer 24 structure of FIG. 3 in order to eliminate the specific term "PiA2–PoA1" from the above referenced WOB equation (1), that is, the outside wellbore fluid pressure compensation apparatus of FIG. 4 and the inside wellbore fluid pressure compensation apparatus of FIG. 5.

In FIGS. 4 and 5, in order to eliminate the specific term (PiA2–PoA1) from equation (1), the additional weight on bit equalizer 24 structure in FIGS. 4 and 5 must be designed to produce a negative of the specific term "–(PiA2-PoA1)" which is equal to (–PiA2+PoA1). Therefore, the specific term associated with the weight on bit equalizer structure of FIG. 3 and the negative of the specific term associated with the outside and inside wellbore fluid pressure compensation apparatus of FIGS. 4 and 5 will cancel out.

The negative of the specific term "–PiA2+PoA1" includes two terms: a first term "–PiA2" and a second term "+PoA1". FIG. 4 illustrates the outside wellbore fluid pressure compensation apparatus representing an additional weight on bit equalizer structure which will produce the second term "+PoA1". FIG. 5 illustrates the inside wellbore fluid pressure compensation apparatus representing a further additional weight on bit equalizer structure which will produce the first term "–PiA2".

In FIG. 4, the outside wellbore fluid pressure compensation apparatus contains the additional weight on bit equalizer structure that produces the second term "+PoA1" (that is adapted to cancel the term –PoA1 of the specific term PiA2–PoA1) comprising a further outer housing 46 and a further inner housing 42*a* which is an extension of the inner housing 42, the further inner housing 42*a* having a piston 42*a*. The piston 42*a* separates a first air chamber 48 from a second mud chamber 50. The further outer housing 46 includes a port 46*a* for allowing a wellbore fluid, such as mud, disposed outside the weight on bit equalizer to enter the second mud chamber 50. The mud disposed outside the weight on bit equalizer exerts a pressure "Po" against an inside surface 46*b* of the further outer housing 46, where the inside surface 46*b* has an area "A1" that is equal to the area "A1" of the outside surface 40*b* in FIGS. 3 and 4. The direction of the pressure Po against the inside surface 46*b* of FIG. 4 is toward the drill bit 10, which is a positive or plus direction since the pressure Po adds to the weight on the drill bit 10. Thus, the pressure Po in the plus direction against inside surface 46*b* having area A1 yields the second term "+PoA1". Therefore, the direction of the pressure Po, being exerted against inside surface 46*b*, has a term +PoA1 which cancels out one part "–PoA1" of the specific term "(PiA2–PoA1)". As a result, the additional structure of the weight on bit equalizer shown FIG. 4 cancels out the term "–PoA1" in the WOB equation (1) above.

In FIG. 5, the inside wellbore fluid pressure compensation apparatus contains the further additional weight on bit equalizer structure that produces the first term "–PiA2" (that is adapted to cancel the term +PiA2 of the specific term PiA2–PoA1) comprising the outer housing 40 disposed over the inner housing 42 defining the precharged nitrogen chamber 44 and a mud chamber 56. The inner housing 42 has a piston 52 and a port 54 which allows a wellbore fluid, such as mud, disposed inside the weight on bit equalizer to enter the mud chamber 56. The mud in mud chamber 56 has a pressure "Pi", and this pressure Pi works against an inside surface 56*a* of the mud chamber 56 having an area "A2" which is equal to the area "A2" of the inside surface 40*a* of FIGS. 3 and 5. The direction of the pressure Pi in mud chamber 56 is away from the drill bit 10 in FIG. 5, which is a negative direction since the pressure Pi subtracts from the weight on the drill bit 10 in FIG. 5. Thus, the pressure Pi in the negative direction against inside surface 56*a* having an area A2 yields the first term "–PiA2". Therefore, the direction of the pressure Pi being exerted against inside surface 56*a* has a term "–PiA2" which cancels out the other part "PiA2" of the specific term "(PiA2–PoA1)".

Therefore, the weight on bit equalizer apparatus 24 in accordance with the first embodiment of the present invention is illustrated by the combination of individual apparatus shown in FIGS. 3, 4, and 5, that is, the nitrogen chamber apparatus of FIG. 3, the outside wellbore fluid pressure compensation apparatus of FIG. 4, and the inside wellbore fluid pressure compensation apparatus of FIG. 5.

Referring to FIGS. 6 and 7, a simplified construction of a second embodiment of the shock sub or weight on bit equalizer 24 of the present invention is illustrated.

FIG. 6 illustrates the simplified construction of the second embodiment of the shock sub or weight on bit 24 equalizer of the present invention. In FIG. 6, note the location of the diameters D0, D1, D2;, D3, D4, D5, and Dx, and recall the following formula which enables one to calculate a cross sectional Area "A" from a diameter "D" of that cross sectional area: Area (A)=pi (D)(D)/4, where pi=3.1416 . . . and D is the diameter. Using that formula, the diameter "D0" translates to an Area "A0", the diameter "D1" translates to an Area "A1", the diameter "D2" translates to an area "A2", the diameter "D3" translates to an area "A3", the diameter "D4" translates to an area "A4", the diameter "D5" translates to an Area "A5", and the diameter "Dx" translates to an Area "Ax".

FIG. 7 illustrates only the outer housing 40 of the second embodiment of the shock sub or weight on bit equalizer 24 of FIG. 6.

In FIGS. 6 and 7, the shock sub or weight on bit equalizer apparatus will be used to derive an equation that describes the forces being exerted on the inside and outside parts of the weight on bit equalizer apparatus associated with the drilling system of FIGS. 1 or 2 and the resultant weight or force being exerted by the drilling system on the drill bit 10 during the drilling operation. When the derivation of such equation is complete, it will become evident that, when the cross sectional area of the air chamber 48 is equal to the cross sectional area of the nitrogen chamber 44 and also equal to the area A3, the only force on the drill bit during the drilling operation is the force resultant from the pressure of the nitrogen in the nitrogen chamber 44; and this produces a constant weight or force on the drill bit 10.

In FIG. 6, a weight on bit equalizer apparatus 24 of the second embodiment of the present invention, associated with a drilling system of FIGS. 1 or 2, includes an outer housing 40 enclosing an inner housing 42 thereby defining the air chamber 48, the second mud chamber 50, the mud chamber 56, and the precharged nitrogen chamber 44. In FIG. 6 and more notably in FIG. 7, the outer housing 40 includes a first piston 40*a*, a second piston 40*b*, a third piston 40*c* and an end piece 40*d*. In FIG. 6, wellbore fluid, in the form of mud, will enter the second mud chamber 50 from outside the drilling system of FIG. 6 via the port 46*a*, and the pressure of the mud in the second mud chamber 50, originating from the outside, is "Po". The mud will also enter the other mud chamber 56 from inside the drilling system of FIG. 6 via the port 54, and the pressure of the mud in the other mud chamber 56, originating from the inside, is "Pi". Nitrogen is already disposed within the precharged nitrogen chamber 44 and the pressure of the nitrogen in the nitrogen chamber 44 is "Pn".

In FIG. 7, having introduced and defined the variables Po, Pi, Pn, A0, A1, A2, A3, A3, A5, and Ax in connection with the above discussion with reference to FIG. 6, find the first piston 40*a*, the second piston 40*b*, the third piston 40*c*, and the end piece 40*d* of the outer housing 40, and note the following pressures which are exerted against the pistons 40*a*, 40*b*, 40*c*, and end piece 40*d* of the outer housing 40:

1. First piston 40*a*: the outside pressure "Po" is exerted against one side of the first piston 40*a* of the outer housing 40, and a zero (0) pressure from inside the air chamber 48 is exerted by the air against the other side of the first piston 40*a*. The cross sectional area of the one side of first piston 40*a*, against which the outside pressure "Po" is exerted, is (A0–A1). Therefore, in FIG. 7, the force exerted against the one side of the first piston 40*a* is "Po(A0–A1)" and the force exerted against the other side of the first piston 40*a* is "0".

As a result, the net force exerted against both sides of the first piston 40*a* is "Po(A0–A1)–0".

2. Second piston 40*b*: the outside pressure "Po" from inside the mud chamber 50 is exerted against one side of the second piston 40*b* of the outer housing, and the cross sectional area of the one side of the second piston 40*b* is (A2–A3). Therefore, in FIG. 7, the force exerted against the one side of the second piston 40*b* is "Po(A2-A3)".

In addition, the inside pressure "Pi" from inside the mud chamber 56 is exerted against the other side of the second piston 40*b*, and the cross sectional area of the other side of the second piston 40*b* is (A3–A3). Therefore, in FIG. 7, the force exerted against the other side of the second piston 40*b* is "Pi(A3–A3)".

As a result, the net force exerted against both sides of the second piston 40*b* is "Po(A2–A3)–Pi(A3–A3)"

3. Third piston 40*c*: the nitrogen precharged pressure "Pn" from inside the nitrogen chamber 44 is exerted against one side of the third piston 40*c* and the cross sectional area of the one side of the third piston 40*c* is (A3–A5). Therefore, in FIG. 7, the force exerted against the one side of the third piston 40*c* is "Pn(A3–A5)".

In addition, the inside pressure "Pi" is exerted from inside the weight on bit equalizer 24 against the other side of the third piston 40*c* and the cross sectional area of the other side of the third piston 40*c* is (Ax–A5). Therefore, in FIG. 7, the force exerted against the other side of the third piston 40*c* is "Pi(Ax–A5)".

As a result, the net force exerted against both sides of the third piston 40*c* is "Pn(A4–A5)–Pi(Ax–A5)".

4. End piece 40*d*: the inside pressure "Pi" is exerted, from inside the equalizer 24, against one side of the end piece 40*d* and the cross sectional area of the one side of the end piece 40*d* is Ax. Therefore, in FIG. 7, the force exerted against the one side of the end piece 40*d* is "PiAx".

In addition, the outside pressure "Po" is exerted, from outside the equalizer 24, against the other side of the end piece 40*d* and the cross sectional area of the other side of the end piece 40*d* is A0. In addition, a force "WOB ", at 40*e*, associated with the weight on the drill bit 10, is exerted against the other side of the end piece 40*d*. Therefore, in FIG. 7, the force exerted against the other side of the end piece 40*d* is "PoA0+WOB".

As a result, the net force being exerted against both sides of the end piece 40*d* is "PiAx–(PoA0+WOB)".

In FIG. 7, recall the following basic algorithm: the summation of the forces in one direction equals zero "ΣF=0" Using this basic algorithm, let us now sum the net forces in FIG. 7 which are being exerted against the first piston 40*a*, the second piston 40*b*, the third piston 40*c*, and the end piece 40*d* of the outer housing 40. Consider the following analysis:

$$\Sigma F = Po(A0-A1)-0+Po(A2-A3)-Pi(A4-A3)+Pn(A4-A5)-Pi\,(Ax-A5)+PiAx-(PoA0+WOB)=0 \quad (2)$$

Collecting the terms of equation (2) and simplifying equation (2), the following equation (3) is the result:

$$Po(A2-A1-A3)+Pi(A3+A5-A4)+Pn(A4-A5)=WOB \quad (3)$$

Similar to the analysis performed above in connection with equation (1), in order to take into account the presence of the wellbore fluid disposed both inside and outside the weight on bit equalizer 24 of the present invention and thereby ensure that only the pressure of the nitrogen in the precharged nitrogen chamber 44 exert a force on the drill bit 10 during drilling of the wellbore (that is, in order to achieve pressure balance), the term "Pn(A4–A5)" in equation (3) must be equal to "WOB". In order for Pn(A4–A5)=WOB, the following particular term of equation (3) must be equal to zero: "Po(A2–A1–A3)+Pi(A3+A5–A4)". In order for that particular term of equation (3) to be equal to zero, the following must also be true: A2–A1–A3=0 and A3+A5–A4=0. However, if A2–A1–A3=0, then, A3=A2–A1. In addition, if A3+A5–A4=0, then, A3=A4–A5. Continuing, if A3=A2–A1 and A3=A4–A5, then, A2–A1=A4–A5.

Therefore, if the cross sectional areas (A2–A1)=(A4–A5) =A3 in FIG. 6, then WOB=Pn(A4–A5) and we have achieved pressure balance.

The cross sectional area (A2–A1) is the cross sectional area of the air chamber 48. The cross sectional area (A4–A5) is the cross sectional area of the nitrogen chamber 44 and the area A3 is the area encompassed by the diameter D3 in FIG. 6.

Therefore, if (A2–A1)=(A4–A5), the cross sectional area of the air chamber 48 is equal to the cross sectional area of the nitrogen chamber 44. However, it has already been established that, when (A2–A1)=(A4–A5) =A3 in FIG. 6, the only weight or force on the drill bit 10 (WOB)=Pn(A4–A5), the force of the nitrogen in the nitrogen chamber 44, and pressure balance has been achieved.

Consequently, when the cross sectional area of the air chamber 48 in FIG. 6 is equal to the cross sectional area of the nitrogen chamber 44 and area A3, pressure balance has been achieved. When pressure balance is achieved, the differential forces in the weight on bit equalizer 24 produced by the mud disposed both inside and outside the equalizer 24 are cancelled out and the only force remaining, within the weight on bit equalizer of the present invention, is the force produced by the nitrogen in the precharged nitrogen chamber 44. The force of the nitrogen in the nitrogen chamber 44 tends to cause the outer housing 40 in FIG. 6 to move longitudinally with respect to the inner housing 42 in FIG. 6 thereby producing a constant weight or force on the drill bit 10 of FIGS. 1 or 2.

Referring to FIG. 8*a* through FIG. 10, a more detailed implementation of the second embodiment of the shock sub or weight on bit equalizer of FIGS. 6–7 is illustrated.

In FIGS. 8*a*–8*e*, the weight on bit equalizer is shown in its collapsed position and, in FIGS. 9*a*–9*e*, the weight on bit equalizer is shown in its extended position. The preferred mode of operation is the collapsed position where, if the drill bit drills off, the weight on bit equalizer can extend to the extended position thus maintaining the weight on the bit, which might otherwise drop to zero in stick slip situations.

Figure 8A:
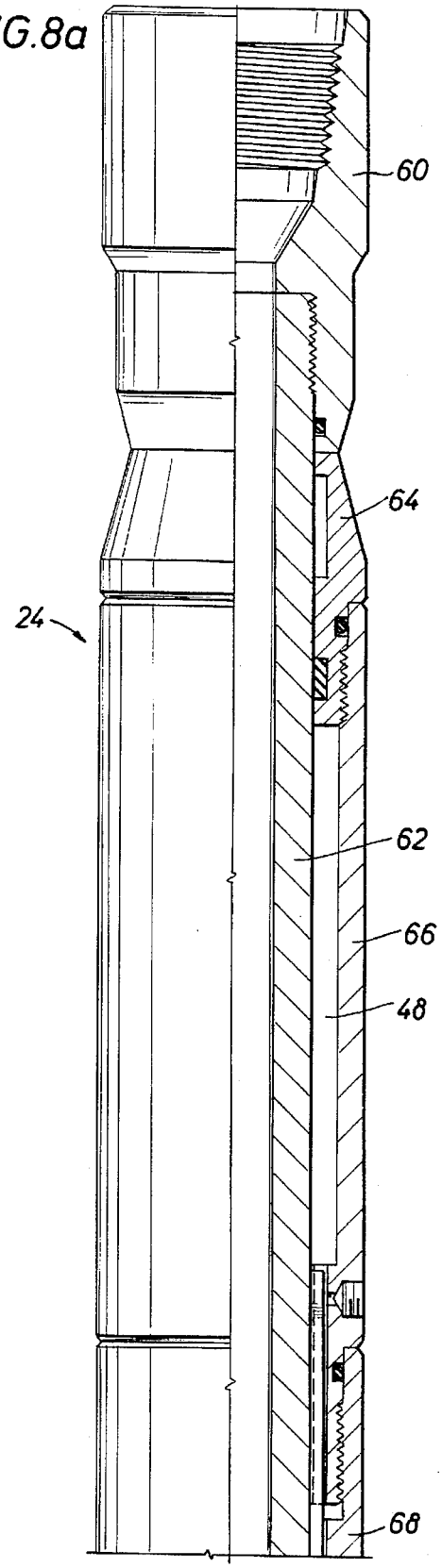
Figure 9A:
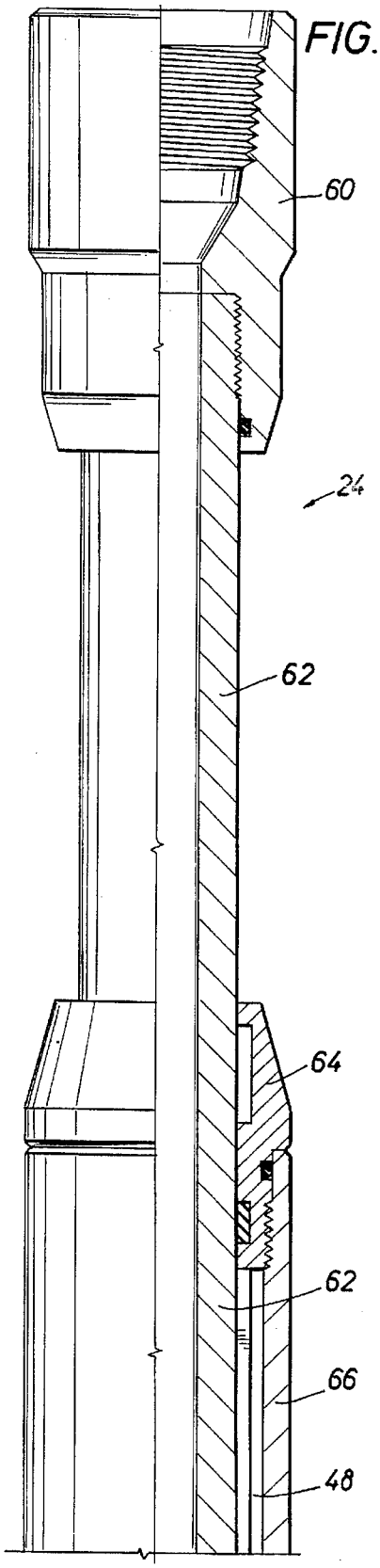
Figure 8B:
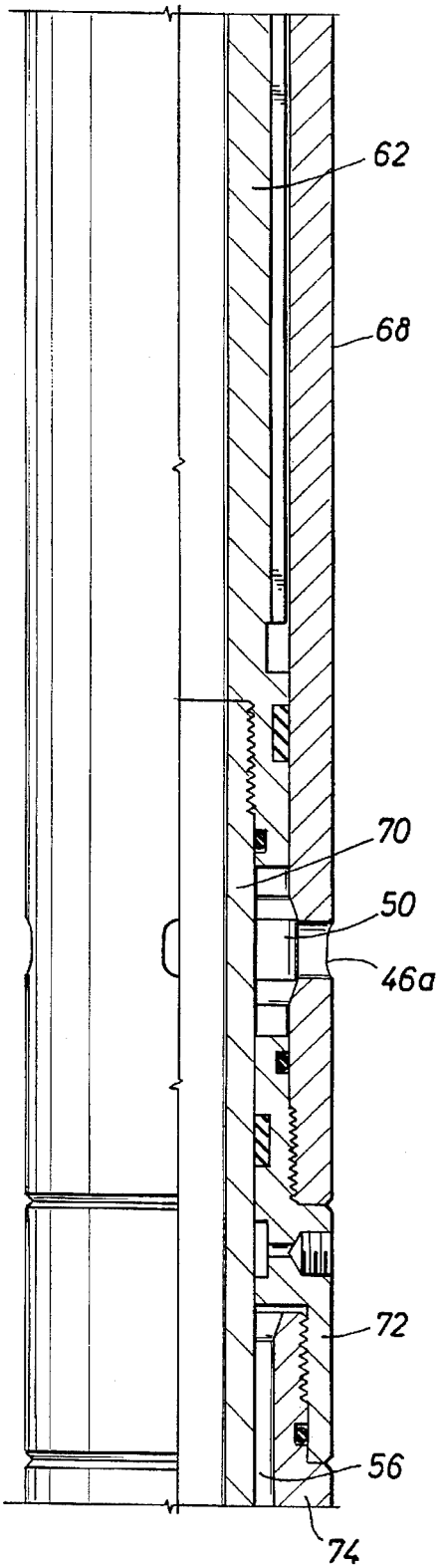
Figure 9B:
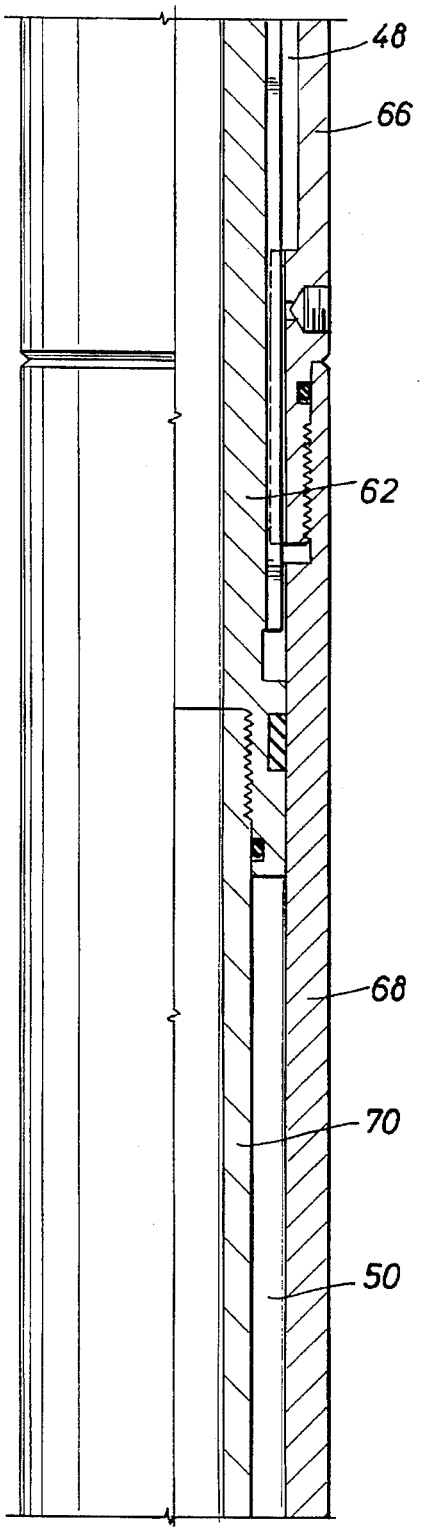

In FIG. 8*a*, the shock sub weight on bit equalizer comprises a first air chamber 48 similar to the first air chamber 48 shown in FIG. 4. In FIG. 8*b*, the port 46*a* fluidly communicates the wellbore fluid disposed outside the weight on bit equalizer with the second mud chamber 50, similar to the port 46*a* and mud chamber 50 shown in FIG. 4. Therefore, FIGS. 8*a*–8*b* illustrate the outside wellbore fluid pressure compensation apparatus shown in the simplified drawing of FIGS. 4 and 6.

Figure 8C:
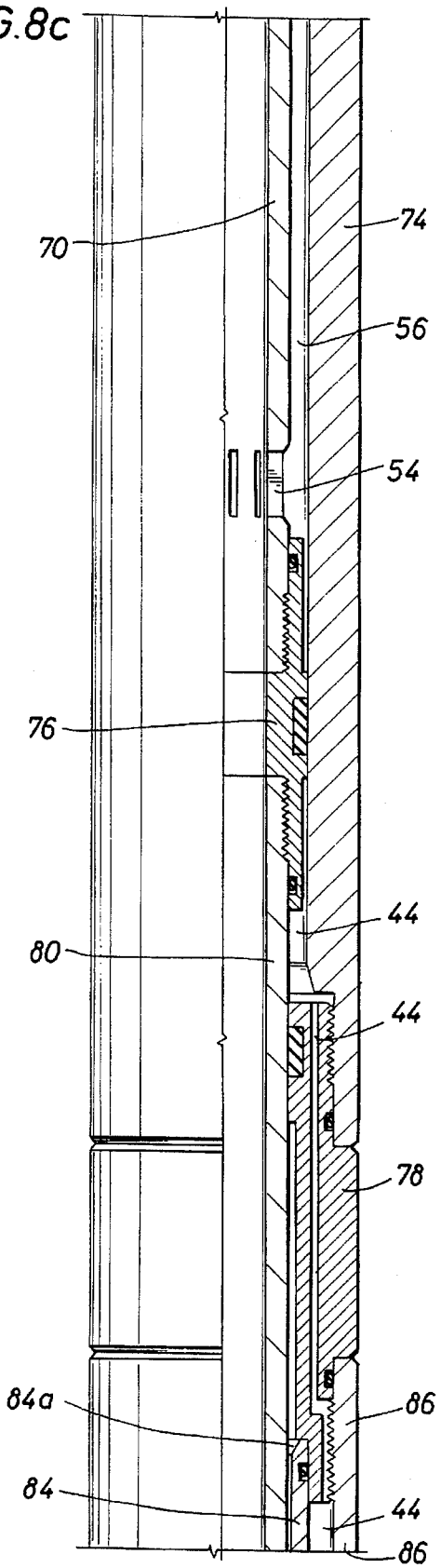
Figure 9C:
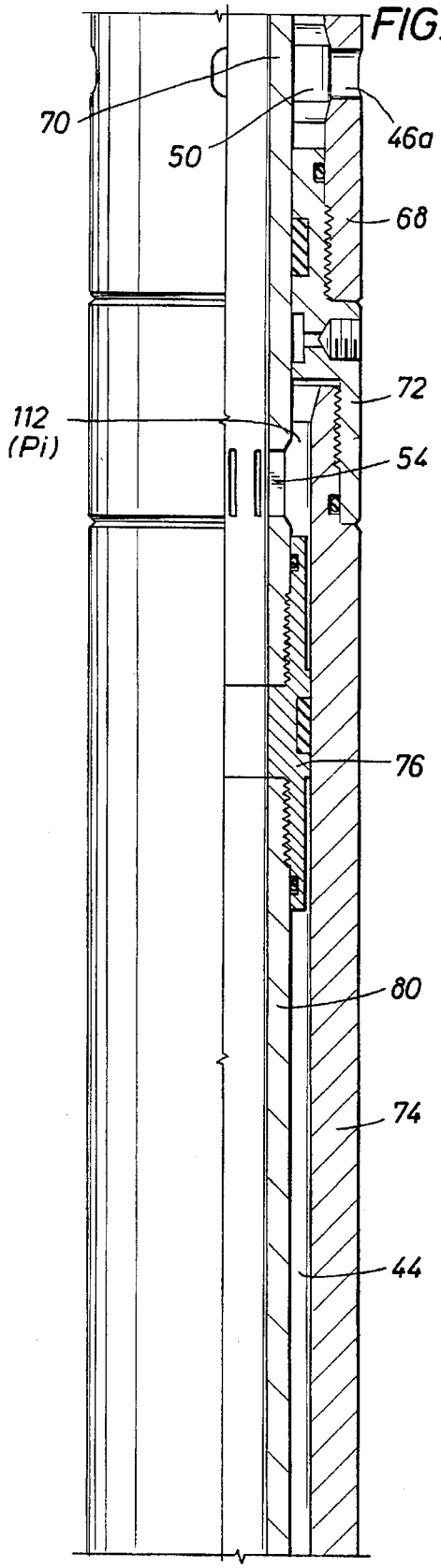

In FIG. 8*c* (and the bottom of FIG. 8*b*), the port 54 fluidly communicates the wellbore fluid, such as mud, disposed inside the weight on bit equalizer with the mud chamber 56, similar to the port 54 and mud chamber 56 shown in FIG. 5. Therefore, FIGS. 8*b* and 8*c* illustrate the inside wellbore fluid pressure compensation apparatus shown in the simplified drawing of FIG. 5 and 6.

Figure 8D:
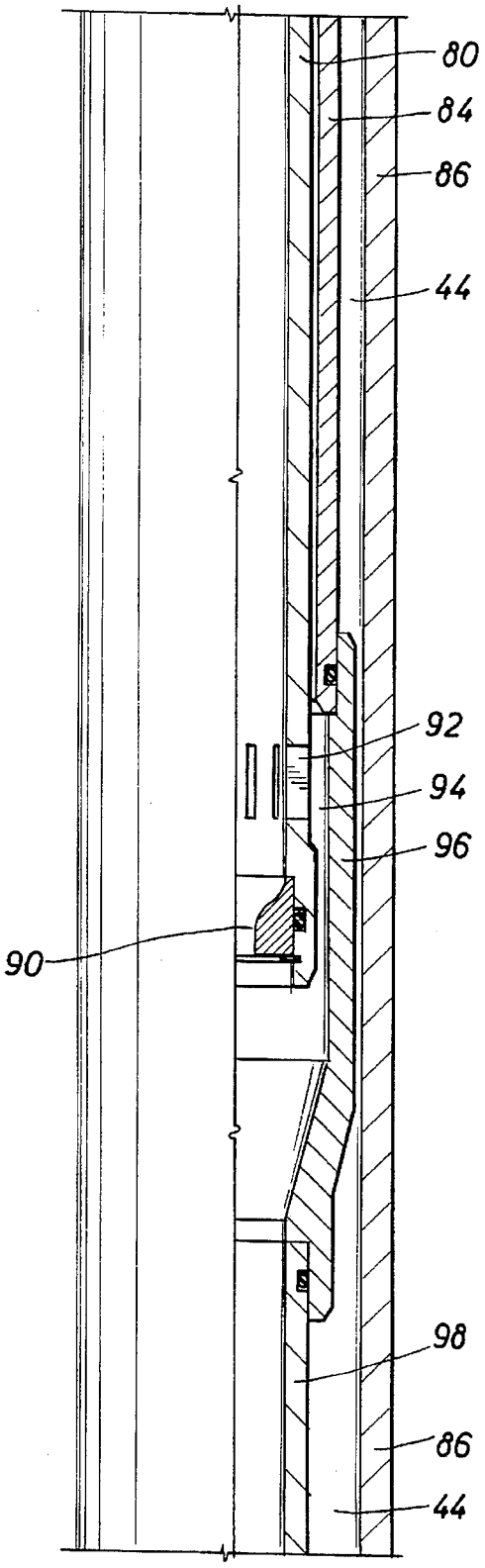
Figure 9D:
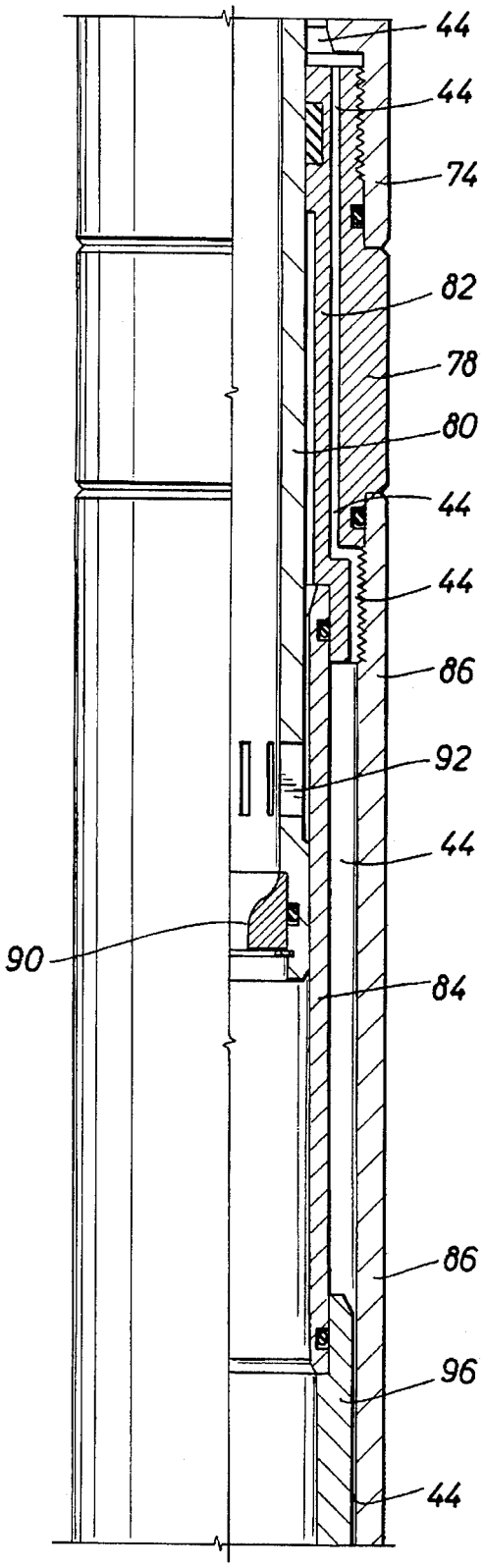

In FIGS. 8*c*, 8*d*, and 8*e*, a precharged nitrogen chamber 44 is filled with nitrogen that is precharged to a predetermined pressure at the surface during manufacture. Therefore, FIGS. 8*c*–8*e* illustrate the precharged nitrogen chamber 44 shown in the simplified drawing of FIG. 3 and 6.

Consequently, the weight on bit equalizer of FIGS. 8*a*–8*e* (and FIGS. 9*a*–9*e*) represent a detailed implementation of the simplified weight on bit equalizer shown in the simplified drawings of FIG. 3 through FIG. 5 and 6.

Beginning with FIG. 8*a*, the weight on bit equalizer of the present invention comprises a top sub 60 threadedly and sealingly connected to a spline mandrel 62. In FIG. 8*a*, a seal housing 64 is threadedly connected to a spline housing 66, and the spline housing 66 is threadedly connected to an air chamber housing 68. The seal housing 64, spline housing 66, and air chamber housing 68 can move longitudinally with respect to the spline mandrel 62 and can move over the surface of the spline mandrel 62.

In FIG. 8*b*, the spline mandrel 62 is threadedly connected to an upper mandrel 70 and it is sealingly connected to the air chamber housing 68. The air chamber housing 68 is threadedly connected to a middle sub 72 and the upper mandrel 70 is sealingly connected to the middle sub 72. The port 46*a* is disposed through the air chamber housing 68 and the second mud chamber 50 is defined by the spline mandrel 62, the upper mandrel 70, the middle sub 72, and the air chamber housing 68. The port 46*a* fluidly communicates the wellbore fluid disposed outside the weight on bit equalizer with the second mud chamber 50 in FIG. 8*b* similar to the function of port 46*a* and mud chamber 50 shown in FIG. 4. The middle sub 72 is threadedly connected to a middle housing 74. The upper mandrel 70 is spaced from the middle housing 74 thereby defining a mud chamber 56 similar to mud chamber 56 shown in FIG. 5.

In FIG. 8*c*, the upper mandrel 70 is threadedly connected to a bypass mandrel sub 76, and the middle housing 74 is sealingly connected to the bypass mandrel sub 76 and is threadedly connected to a nitrogen bypass housing 78. The port 54, similar to port 54 in FIG. 5, is disposed through the upper mandrel 70 and fluidly communicates the wellbore fluid disposed inside the weight on bit equalizer with the mud chamber 56. The bypass mandrel sub 76 is threadedly connected to a bypass mandrel 80. A precharged nitrogen chamber 44, similar to the precharged nitrogen chamber 44 of FIG. 3, is disposed between and is defined by the bypass mandrel 80 and the middle housing 74, and the precharged nitrogen chamber 44 is also defined by the bypass mandrel sub 76 and the nitrogen bypass housing 78. The nitrogen bypass housing 78 is threadedly connected to a nitrogen housing 86. A nitrogen upper mandrel 84 contacts, at 84*a*, nitrogen bypass housing 78, the precharged nitrogen chamber 44 being further defined by the nitrogen upper mandrel 84 and the nitrogen housing 86.

In FIG. 8*d*, the bypass mandrel 80 terminates with a bit nozzle 90, the bypass mandrel 80 having a port 92 disposed therethrough for allowing a wellbore fluid, such as mud, to flow from inside the weight on bit equalizer to a space 94 disposed between the bypass mandrel 80 and a bypass housing 96. The nitrogen upper mandrel 84 is sealingly connected to the bypass housing 96. The precharged nitrogen chamber 44 is shown disposed between the nitrogen upper mandrel 84 and the nitrogen housing 86 and between the bypass housing 96 and the nitrogen housing 86. The bypass housing 96 is further sealingly connected to a nitrogen inner mandrel 98, the precharged nitrogen chamber 44 being disposed between the nitrogen inner mandrel 98 and the nitrogen housing 86.

In FIG. 8*e*, the nitrogen inner mandrel 98 is shown spaced from the nitrogen housing 86, and the precharged nitrogen chamber 44 is disposed between the inner mandrel 98 and the nitrogen housing 86. A bottom sub 100 is threadedly connected to the nitrogen housing 86 and is sealingly connected to the nitrogen inner mandrel 98. A port plug and shuttle valve 102, when open, is used to fill the nitrogen chamber 44 with nitrogen which is precharged to a predetermined pressure.

FIG. 10, illustrating a cross section of the bottom sub 100 taken along section lines 10—10 of FIGS. 8*e* and 9*e*, shows a detailed construction of the port plug and shuttle valve 102.

FIGS. 9*a*–9*e* illustrate the same weight on bit equalizer as shown in FIGS. 8*a*–8*e*, except that, in response to a decreased force on drill bit 10 of FIGS. 1–2, the precharged nitrogen present in the precharged nitrogen chamber 44 has placed the weight on bit equalizer in the extended position shown in FIGS. 9*a*–9*e*. As a result, in FIGS. 8*a*–8*e* compared with FIGS. 9*a*–9*e*, during the time when the nitrogen chamber 44 places the weight on bit equalizer in the extended position, the seal housing 64 moves downwardly with respect to the top sub 60. As a further result, the spline housing 66 and air chamber housing 68 of FIG. 8*a* moves downwardly with respect to the spline mandrel 62; the air chamber housing 68, middle sub 72, and middle housing 74 moves downwardly in FIG. 8*b* with respect to the spline mandrel 62 and the upper mandrel 70; the middle housing 74, nitrogen bypass housing 78, nitrogen housing 86, and nitrogen upper mandrel 84 moves downwardly in FIG. 8*c* with respect to the upper mandrel 70, bypass mandrel sub 76, and bypass mandrel 80; the nitrogen upper mandrel 84, bypass housing 96, nitrogen inner mandrel 98, and nitrogen housing 86 moves downwardly in FIG. 8*d* with respect to the bypass mandrel 80 and bit nozzle 90; and the entire bottom sub 100, nitrogen inner mandrel 98, and nitrogen housing 86 of FIG. 8*e* moves downwardly.

A functional description of the operation of the second embodiment of the weight on bit equalizer of the present invention will be set forth in the following paragraphs with reference to FIGS. 1, 2, 6, 7, and FIGS. 8*a* through 9*e* of the drawings.

The drilling tool of either FIG. 1 or FIG. 2 is disposed in a wellbore. The drill bit 10 contacts the earth formation and fluid in the coiled tubing 16 drives the mud motor 12 which rotates the drill bit 10. The weight on the drill bit 10 maintains the constant contact which is required between the drill bit and the formation in order to drill a wellbore in the earth formation. However, the drilling tool of FIGS. 1 or 2 may encounter a "stick-slip" situation. When the "stick-slip" situation is encountered, the drilling system of FIG. 1, for example, becomes temporarily stuck in the wellbore. The side walls of the drilling tool may become temporarily stuck in the wellbore and the contact force between the drill bit 10 of FIG. 1 and the earth formation will begin to decrease. When this happens, the weight on bit equalizer 24, of the present invention, of FIGS. 1 or 2, will begin to change from a collapsed condition, as shown in FIGS. 8*a*–8*e*, to an extended condition, as shown in FIGS. 9*a*–9*e*. The constant contact between the drill bit 10 and the earth formation will be maintained.

In other words, the weight on bit equalizer 24 of FIGS. 3–7, 8*a*–9*e* will function, in principle, like a shock absorber. When the drill bit 10 contacts the earth formation, the weight on bit equalizer of the present invention will begin to prevent the weight on bit load from dropping to zero suddenly.

In FIGS. 8*a*–9*e*, when the "stick-slip" situation is encountered, the weight on bit equalizer changes from the collapsed condition to the extended condition. When the weight on bit equalizer changes to the extended condition, the precharged nitrogen chamber 44 of FIGS. 8*d*–8*e* will force various parts of the weight on bit equalizer 24 of FIGS. 8*a*–8*e* to move with respect to other parts of the weight on bit equalizer 24. More particularly, the seal housing 64 moves downwardly with respect to the top sub 60. As a further result, the spline housing 66 and air chamber housing 68 of FIG. 8*a* moves downwardly with respect to the spline mandrel 62; the air chamber housing 68, middle sub 72, and middle housing 74 moves downwardly in FIG. 8*b* with respect to the spline mandrel 62 and the upper mandrel 70; the middle housing 74, nitrogen bypass housing 78, nitrogen housing 86, and nitrogen upper mandrel 84 moves downwardly in FIG. 8*c* with respect to the upper mandrel 70, bypass mandrel sub 76, and bypass mandrel 80; the nitrogen upper mandrel 84, bypass housing 96, nitrogen inner mandrel 98, and nitrogen housing 86 moves downwardly in FIG. 8*d* with respect to the bypass mandrel 80 and bit nozzle 90; and the entire bottom sub 100, nitrogen inner mandrel 98, and nitrogen housing 86 of FIG. 8*e* moves downwardly. At this point, the weight on bit equalizer is in the extended position as shown in FIGS. 9*a*–9*e*. The wellbore fluid, such as mud, disposed inside the weight on bit equalizer will fill the mud chamber 56 via port 54 and the wellbore fluid, such as mud, disposed outside the weight on bit equalizer will fill the mud chamber 50 via port 46*a*.

The weight on bit equalizer 24 of FIGS. 8*a*–9*e* was built with the following dimensional limitations: A2–A1=A4–A5=A3, where A2, A1, A4, A3, and A5 are defined, by reference to FIG. 6, to be the following cross sectional areas: the area A2 is the cross sectional area within a boundary defined by an outer wall of the air chamber 48, A1 is the cross sectional area within a boundary defined by an inner wall of the air chamber 48, A4 is the cross sectional area within a boundary defined by the outer wall of the nitrogen chamber 44, A3 is the cross sectional area defined by the inner wall of the second mud chamber 50 and the nitrogen chamber 44, and A5 is the cross sectional area within a boundary defined by an inner wall of the nitrogen chamber 44.

Since the weight on bit equalizer 24 of FIGS. 8*a*–9*e* inherently includes the dimensional limitation (A2–A1)=(A4–A5)=A3, the cross sectional area of the air chamber 48 is equal to the cross sectional area of the nitrogen chamber 44 and area A3, and, when the cross sectional area of the air chamber 48 is equal to the cross sectional area of the nitrogen chamber 44 and area A3, the only weight or force on the drill bit 10 (the "WOB") is the force of the nitrogen in the nitrogen chamber 44.

That is, when the weight on bit equalizer 24 of FIGS. 1, 2, 8*a*–9*e* is used in the drilling tool string of FIGS. 1 or 2, the only weight on the drill bit 10 of FIG. 1 will be the weight resultant from the following term of equation (3) above (neglecting friction), where Pn, A4 and A5 are defined above with reference to FIGS. 6 and 7:

$$WOB=Pn(A4-A5). \quad (4)$$

Since this term of equation (4) above results solely from the pressure resulting from the precharged nitrogen in the nitrogen chamber 44 of FIGS. 8*c*–8*e*, the only weight on the drill bit 10 FIGS. 1 or 2 will be that weight which results solely from the pressure of the nitrogen in nitrogen chamber 44. As a result, a constant pressure or weight will be exerted on drill bit 10 (and between drill bit 10 and the earth formation) regardless of the wellbore fluid pressures disposed either inside or outside the weight on bit shock sub of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A shock sub adapted for use with a drilling system where the drilling system includes a drill bit adapted for drilling a wellbore in a formation, said shock sub adapted to maintain a constant weight or force on said drill bit during the drilling of said wellbore, said shock sub comprising:

an inner housing and an outer housing enclosing the inner housing thereby defining a gas chamber and additional chambers, a force existing in said gas chamber and additional forces existing in said additional chambers when said drilling system is drilling said wellbore, a sum of said force in said gas chamber and said additional forces in said additional chambers being approximately equal to said force in said gas chamber, said weight or force on said drill bit being approximately equal to said force in said gas chamber.

2. The shock sub of claim 1, wherein said additional chambers include a low pressure chamber.

3. The shock sub of claim 2, wherein said additional chambers include a first wellbore fluid chamber adapted to be pored to an outside of said shock sub and to receive a wellbore fluid composition from said outside and into said first wellbore fluid chamber.

4. The shock sub of claim 3, wherein said additional chambers include a second wellbore fluid chamber adapted to be ported to an inside of said shock sub and to receive a wellbore fluid composition from said inside and into said second wellbore fluid chamber.

5. A shock sub adapted for use with a drilling system, said drilling system including a drill bit, said drill bit adapted for pressing against a formation and drilling a wellbore in said formation, comprising:

an inner housing;

an outer housing enclosing said inner housing;

an atmospheric chamber defined by said outer housing and said inner housing;

a gas chamber including a gas under pressure defined by said outer housing and said inner housing and adapted to telescopically move said outer housing relative to said inner housing;

an outside wellbore fluid pressure compensation apparatus; and an inside wellbore fluid pressure compensation apparatus, said outside wellbore fluid pressure compensation apparatus in combination with said inside wellbore fluid pressure compensation apparatus, and further wherein the outside wellbore fluid pressure compensation apparatus and the inside fluid pressure compensation apparatus each are in combination with the gas chamber, thereby providing a constant force to said drill bit, the constant force being provided by said said drill bit to said formation during the drilling of said wellbore.

6. A shock sub adapted for use with a drilling system, said drilling system including a drill bit, said drill bit adapted for pressing against a formation and drilling a wellbore in said formation, comprising:

an inner housing; and an outer housing enclosing said inner housing thereby defining an air chamber, a first mud chamber ported to an outside of said outer housing, a second mud chamber pored to an inside of said inner housing, and a gas chamber including a gas under pressure, a cross sectional area of said air chamber being approximately equal to a cross sectional area of said gas chamber, a force of said drill bit of said drilling system against said formation being approximately equal to said force of said gas in said gas chamber.

7. The shock sub of claim 6, wherein said force of said gas in said gas chamber is approximately equal to Pn(A4–A5), where A4–A5 is a cross sectional area of said gas chamber and Pn is a pressure of said gas in said gas chamber.

8. The shock sub of claim 6, wherein said gas in said gas chamber telescopically moves said outer housing with respect to said inner housing, said drill bit of said drilling system pressing against said formation during the drilling of said wellbore when said outer housing telescopically moves with respect to said inner housing thereby creating a force of said drill bit against said formation, said force of said drill bit against said formation being approximately equal to said force of said gas in said gas chamber, said force of said gas in said gas chamber being approximately equal to Pn(A4–A5), where A4–A5 is a cross sectional area of said gas chamber and Pn is a pressure of said gas in said gas chamber.

9. A method of providing a constant force of a drill bit of a drilling system against an earth formation during a drilling of a wellbore in said formation, comprising the steps of:

telescopically moving an outer housing of a shock sub with respect to an inner busing of said shock sub in response to a pressure of a gas in a gas chamber of said shock sub during the drilling of said wellbore in said formation, said shock sub further including at least one mud chamber for receiving a mud composition and an air chamber, a cross sectional area of said air chamber being approximately equal to a cross sectional area of said gas chamber; and applying said drill bit against said formation in response to the moving step thereby creating a force of said drill bit against said formation, said force of said drill bit against said formation being approximately equal to a force of said gas in said gas chamber, said force of said gas in said gas chamber being approximately equal to said pressure of said gas in said gas chamber multiplied by said cross sectional area of said gas chamber, said force of said drill bit against said formation being approximately constant when said force of said drill bit against said formation is approximately equal to said pressure of said gas in said gas chamber multiplied by said cross sectional area of said gas chamber.

10. In a drilling system adapted for drilling a wellbore in an earth formation including a drill bit adapted for pressing against said formation and drilling said wellbore in said formation and a weight on bit shock sub adapted for providing a constant force of said drill bit against said formation during the drilling of said wellbore in said formation, said shock sub comprising:

an inner housing and an outer housing telescopically movable with respect to said inner housing and enclosing said inner housing thereby defining a gas chamber between said outer housing and said inner housing containing a gas under pressure, said outer housing telescopically moving with respect to said inner housing and said drill bit providing said constant force against said formation during the drilling of said wellbore in response to a resultant force in said gas chamber provided by said pressure of said gas in said gas chamber, said resultant force in said gas chamber being equal to said pressure of said gas in said gas chamber multiplied by a cross sectional area of said gas chamber.

11. The shock sub of claim 10, further comprising:

an air chamber disposed between said outer housing and said inner housing, said air chamber having a cross sectional area, said gas chamber having a cross sectional area, the cross sectional area of said air chamber being approximately equal to the cross sectional area of said gas chamber.

12. The shock sub of claim 11, further comprising:

a first fluid chamber disposed between said outer housing and said inner housing adapted for holding a wellbore fluid, and a port disposed through a wall of said inner housing thereby fluidly communicating an interior of said first fluid chamber with an interior of said shock sub, said wellbore fluid flowing from said interior of said shock sub into said interior of said first fluid chamber.

13. The shock sub of claim 12, further comprising:

a second fluid chamber disposed between said outer housing and said inner housing adapted for holding a wellbore fluid, and a port disposed through a wall of said outer housing thereby fluidly communicating an interior of said second fluid chamber with an exterior of said shock sub, said wellbore fluid flowing from said exterior of said shock sub into said interior of said second fluid chamber.

14. A method of providing an approximately constant force by a drill bit against a formation when drilling a wellbore in said formation, comprising the steps of:

telescopically moving an outer housing of a shock sub with respect to an inner housing of said shock sub in response to a pressure of a gas in a gas chamber in said shock sub when drill bit is drilling said wellbore in said formation; and providing said approximately constant force by said drill bit against said formation during the drilling of said wellbore in response to the moving step, the approximately constant force of said drill bit against said formation being set forth in an equation, said equation being WOB=Pn(A), where WOB is the approximately constant force of said drill bit against said formation, Pn is said pressure of said gas in said gas chamber in said shock sub, and A is a cross sectional area of said gas chamber.

15. The method of claim 14, wherein said shock sub further includes an air chamber, a first mud chamber adapted to be filled with a mud flowing from inside said shock sub, and a second mud chamber adapted to be fried with a mud flowing from outside said shock sub, and wherein the providing step further includes the steps of:

providing said approximately constant force by said drill bit against said formation in response to the moving step, said constant force being set forth in said equation WOB=Pn(A), a cross sectional area of said air chamber being approximately equal to a cross sectional area of said gas chamber, said approximately constant force "WOB" in said equation being equal to said "Pn(A)" in said equation when said cross sectional area of said air chamber is approximately equal to said cross sectional area of said gas chamber.

* * * * *